US005222860A

United States Patent [19]

Kamath et al.

[11] Patent Number: 5,222,860

[45] Date of Patent: Jun. 29, 1993

[54] FLOOR SPACE EFFICIENT PRINTER WITH HIGH LOAD AND UNLOAD CAPABILITY

[75] Inventors: Venkatesh H. Kamath, Fairport; Michael A. Malachowski; David R. Kamprath, both of Webster, all of N.Y.

[73] Assignee: Xerox Corporation, Stamford, Conn.

[21] Appl. No.: 904,115

[22] Filed: Jun. 25, 1992

[51] Int. Cl.[5] ..... B65G 59/02

[52] U.S. Cl. ..... 414/795.8; 271/3; 271/9; 414/928; 414/929

[58] Field of Search ..... 271/3, 9, 207; 414/928, 414/929, 795.8, 222, DIG. 6

[56] References Cited

U.S. PATENT DOCUMENTS

| | | | |
|---|---|---|---|
| 4,451,191 | 5/1984 | Torre | 271/9 X |
| 4,703,924 | 11/1987 | Marass | 271/9 |
| 5,096,181 | 3/1992 | Menon et al. | 271/157 |

FOREIGN PATENT DOCUMENTS

| | | | |
|---|---|---|---|
| 0370836 | 5/1990 | European Pat. Off. | 271/9 |
| 0071057 | 6/1977 | Japan | 414/928 |
| 0070622 | 3/1990 | Japan | 414/795.8 |

*Primary Examiner*—H. Grant Skaggs
*Assistant Examiner*—Carol Lynn Druzbick
*Attorney, Agent, or Firm*—Oliff & Berridge

[57] ABSTRACT

High speed printers with extended run capabilities are disclosed. A plurality of like containers are provided for carrying copy sheets to the printer and for receiving copy output from the printer. The containers are fed one after the other to supply input sheets or receive output sheets. Spent input trays or filled output trays are moved transversely to the exterior of the printer. Conveyors are utilized for the continuous feeding of copy sheet input containers or copy sheet receiving containers.

19 Claims, 3 Drawing Sheets

FLOOR SPACE EFFICIENT PRINTER WITH HIGH LOAD AND UNLOAD CAPABILITY

BACKGROUND OF THE INVENTION

1. Field of the Invention

This invention relates to document printers and particularly to space efficient document printers which can run without operator intervention for extended periods of time.

2. Description of Related Art

High speed document printers capable of print rates in excess of 200 pages per minute using xerographic and inkjet printing engines have been developed. As printer throughput rates increase, a larger percentage of operator time is spent loading copy sheets into and unloading printed output from the machine. To overcome this limitation, load-while-run features have been developed to allow the printer to continue operating while paper is loaded and output is unloaded from the printer. One such arrangement is illustrated in U.S. Pat. No. 5,096,181. In general, this system utilizes two sheet stack receiver elements, one of which is positioned in an input position for stack feeding or an output position for stack formation. The second receiver is movable and can be loaded or unloaded by an operator while sheet feeding or stack formation is taking place at the first receiver. When the stack of copy sheets in the first receiver is exhausted (in the copy sheet input stage) or completed (in the copy sheet output stage) a transfer mechanism moves a new stack of copy sheets to the first receiver from the second receiver or moves a completed stack of printed sheets from the first receiver to the second receiver. In general, this system is relatively slow and makes inefficient use of feeder and elevator hardware because the transfer operation is relatively slow. This causes a significant interruption in the operation of the printer and reduces throughput. Also, the receivers are enclosed within the printer and it is difficult to quickly visualize when attention to the second receiver is necessary. This is disadvantageous when it is desirable to have a large number of printers attended by a minimum number of operators, as production is interrupted if the printers must stop because of a lack of supply of copy sheets or the need to remove copy output.

SUMMARY OF THE INVENTION

It is an object of the invention to provide printers with high capacity copy sheet input and output sections.

It is a further object of the invention to minimize the need for operator intervention in loading and unloading printers.

It is a further object of the invention to provide printer input and output loading arrangement which readily indicate the need for operator attention.

It is yet another object of the invention to provide high capacity printers that are highly space efficient.

These and other objects of the invention are provided by a printer having a plurality of input stack members and/or output stack receiving members which are moved one after the other into supply or receiving positions. Stacking members that are exhausted at the input or at capacity at the output are moved to the exterior of the printer housing for action by the operator. A continuous conveying system may be provided for shifting stack receiving containers from an output position to an input position of the printer.

DESCRIPTION OF PREFERRED EMBODIMENTS

Figure 1:
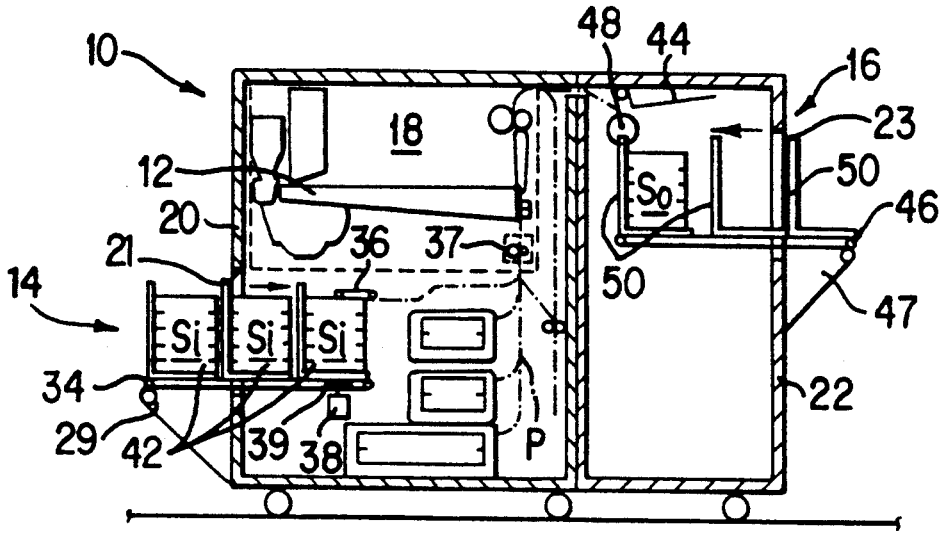
FIG. 1 is an elevational cross-sectional view of a printer having stack input and stack output arrangements in accordance with the invention.

Referring to FIG. 1, a printer 10 incorporating the present invention is illustrated. The printer 10 includes an imaging section 12, which comprises known types of marking engines, such as electrostatic or inkjet printers. The type of printing system utilized does not form a part of the invention and further details thereof are not essential.

The printer 10 includes a copy sheet input section 14, described in greater detail below. Copy sheets of various sizes are supplied from the copy sheet input section 14 and are fed along path P, by appropriate means, to the printing section 12. The copy sheets may be single side or duplex printed (for double sided reproduction), and then are carried to output section 16, which is described in further detail below.

The printing section 12, portions of the input section 14 and portions of the output section 16 are housed within a housing 18. The housing 18 includes an end wall 20 at the copy sheet input side of the printer. An opening 21 is formed in end wall 20. A second end wall 22, in opposed relation to end wall 20, includes an opening 23. A front wall 24 (FIG. 2) extends along the front of the housing between end wall 20 and end wall 22. The front wall 24 includes an opening 26 in communication with an unloading station 27, preferably comprising a surface 28 extending from the front wall 24. The front wall 24 also includes an opening 30 communicating the interior of the housing 18 with an unloading station 31 which preferably comprises outwardly extending surface 32.

An outwardly extending extension 29 is disposed on end wall 20 beneath opening 21 and supports one end of conveyor 34 comprising, for example a pair of continuous conveyor belts, which extend from a location outside the housing 18 to a sheet feeding position in the interior of the housing. An endmost one of copy sheet supply stacks $S_1$ is positioned so that sheet feeder 36 can feed sheets serially into the feed path P to be conveyed to the printer section 12. The sheet feeder 36 can be any of a number of known designs and no further details thereof are necessary. The input sheet stacks $S_1$ are held in a plurality of like containers or holders 42 which are described in further detail below. A plurality of containers 42, for example three as shown in FIG. 1, are positioned by the conveyor 34, one after the other, beneath the sheet feeder 36.

Beneath the endmost stack of copy sheets being supplied to the sheet feeder 36 is an elevating means 38. The elevating means 38 can comprise a fluid cylinder or motor driven screw shaft that is utilized to elevate the stack of sheets as they are fed by the sheet feeder 36. A suitable arrangement is further described in connection with FIGS. 5 and 6 below. Sheets are fed by the sheet feeder 36 into the feed path P. In order to obtain proper registration of the sheets with the printing engine 12, a sheet registration arrangement 37 is utilized. Preferably, an electronic, translating sheet registration system as disclosed in U.S. Pat. No. 5,094,442 (the disclosure of which is incorporated by reference herein) is utilized. Such a system can operate in a short paper path to perform deskew, side shift and lead edge registration functions.

Figure 2:
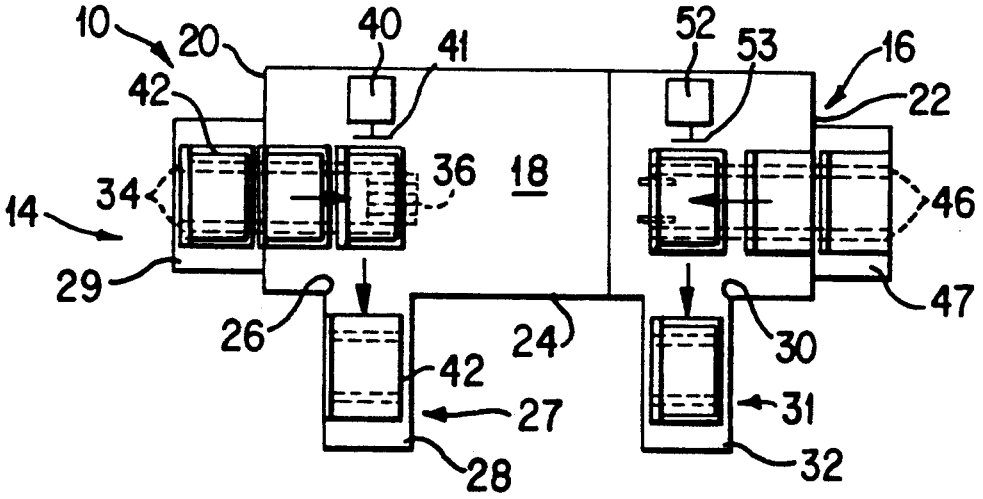
FIG. 2 is a sectional plan view of the printer shown in FIG. 1.

As shown in FIG. 2, means 40 are provided within the housing 18 for moving empty containers 42 away from the sheet unloading position adjacent the feeder 36 to the unloading station 27. The unloaded container 42 is moved in a direction transverse to the direction of the input path of the containers 42. The container moving means 40 can comprise a fluid motor with a plate 41 positioned for engagement of a side surface of the frame 42. Alternately, other means or conveying structures are useable for this purpose.

The copy sheet output section 16 includes a tray 44 for receiving individual copy sheet under single sheet or low copy number conditions. For high copy sheet output, the copy output section includes a plurality of containers 50 which can be the same as the containers 42 used in the input section 14 or which are modified specifically for output purposes. The containers 50 are positioned for feeding, one after the other, into a sheet receiving location by a conveyor 46. The conveyor 46 can comprise a pair of belts supported at an outer end by extension 47 extending from the end wall 22 of the housing 18 and, at an inner end, adjacent a sheet stacker 48. The end most container 50 is positioned to receive output copy sheets from the stacker 48. If desirable, an elevator structure (not shown) similar in operation to elevator 38, can be provided for controlling the vertical height of the output stack $S_o$ received in the endmost container 50.

Adjacent the container 50 receiving output stack $S_o$ is a container moving means 52, similar to container moving means 40. The container moving means 52 can comprise a fluid or other motor which drives a plate 53 for engaging a side surface of the tray endmost container 50. In this manner, the container 50 is driven in a transverse direction, through opening 30 in the front wall 24 to the unloading station 31, where the output stack $S_o$ can be removed from the printer.

Figure 3:
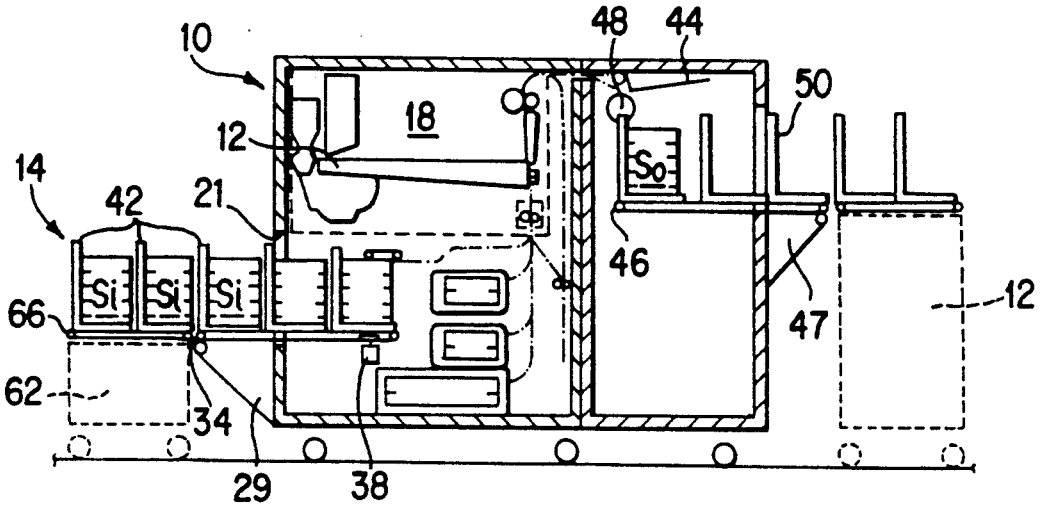
FIG. 3 is a cross-sectional elevational view of the printer shown in FIG. 1 having continuous input and output sections.
Figure 4:
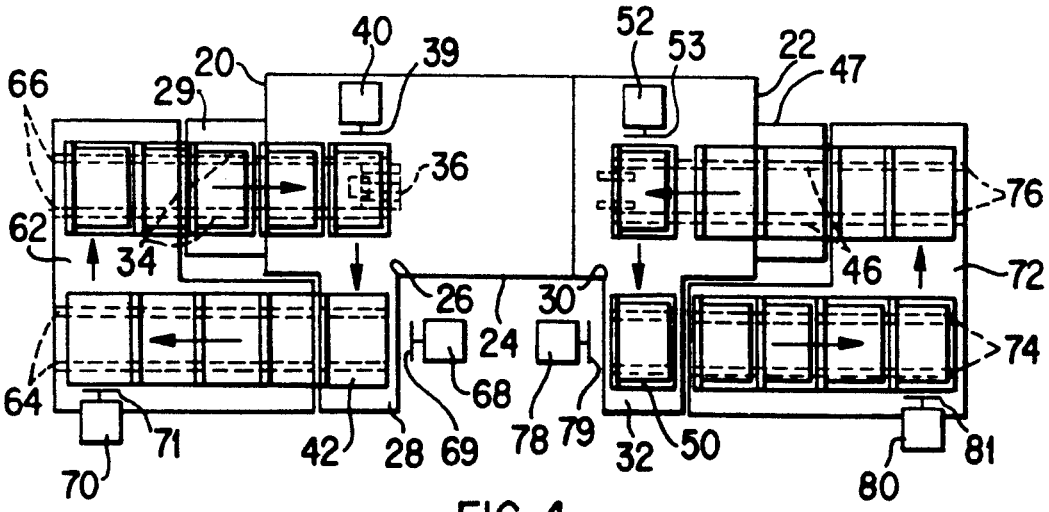
FIG. 4 is a sectional plan view of the arrangement shown in FIG. 3.

Referring to FIGS. 3 and 4, number of operator visits to the printer shown in FIGS. 1 and 2 can be reduced by the provision of conveyor structures for moving container 42 and/or containers 50 from the unloading stations 27, 31, in a continuous manner to the input conveyors 34 and 46, respectively. To achieve a continuous input function, a generally L-shaped member 62 is provided which extends from the unloading station 27 to the input end of the conveyor 34. Preferably, the member 62 is provided with a pair of parallel conveyor structures 64 and 66. Conveyor structure 64 can comprise a pair of belts aligned with and positioned to receive frames 42 from the unloading station 28. Containers are moved from the unloading station 27 by a suitable translating means, such as a fluid motor 68 having a plate 69 for engaging a side surface of the container 42. The fluid motor 68 operates to push the container 42 onto the conveyor 64, which can convey the containers 42, one after the other, by gravity or otherwise to a position adjacent another container moving means 70. The moving means 70 can comprise a fluid motor with a plate 72 for moving the endmost container 42 on the conveyor 64 transversely onto the conveyor 66. The conveyor 66 moves the container 42 onto the input conveyor 34. This can be accomplished by canting the conveyor 66 to provide gravity feed or by positively driving conveyor 66 by a suitable drive means (not shown).

In this fashion, a plurality of containers 42, in a continuous sequence, are provided for the input of copy sheets to the printing station 12. In this arrangement, a plurality of empty containers 42 can be accommodated on the conveyor 64 thereby reducing the need for immediate operator attention, as a plurality of full containers can be loaded at one time by the operator.

As shown in FIGS. 3 and 4, a similar arrangement can be provided with respect to output section 16. As shown, a container moving means comprising a fluid motor 78 which drives a plate 79 is positioned opposite the unloading station 31 for moving containers 50 laterally from the unloading station. An L-shaped member 72 is provided which extends from the unloading station 31 to the input conveyor 46. The L-shaped member 72 includes a pair of parallel conveyors 74 and 76. The tray moving member 78 pushes the containers 50 from the unloading station 31 onto the conveyor 74. The containers 50 thereafter move, one after the other, to a position adjacent another container moving means 80, which comprises a fluid motor arranged to drive a plate 81, which plate pushes the endmost container 50 transversely onto the conveyor 76. Trays on the conveyor 76 are conveyed, by gravity or by positive drive to the input conveyor 46.

Figure 5:
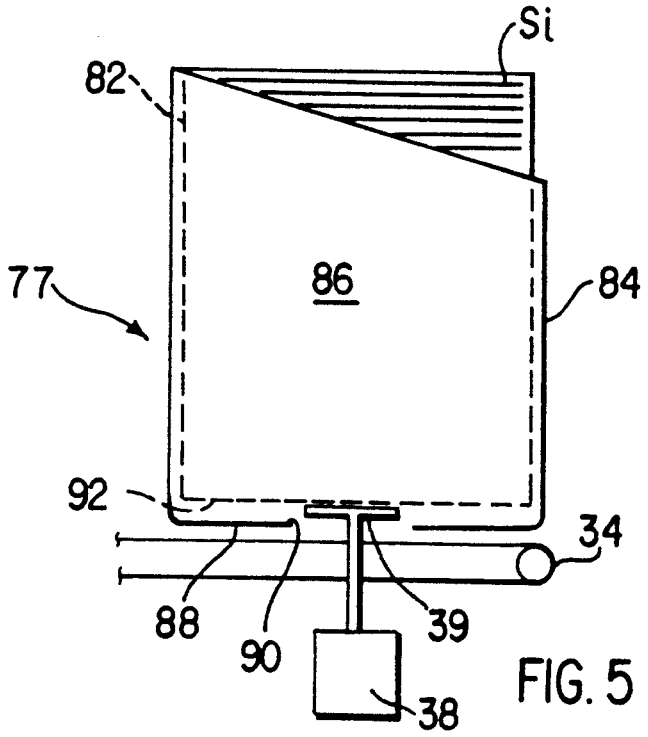
FIG. 5 is a schematic elevational view of a stack container in sheet unloading position.
Figure 6:
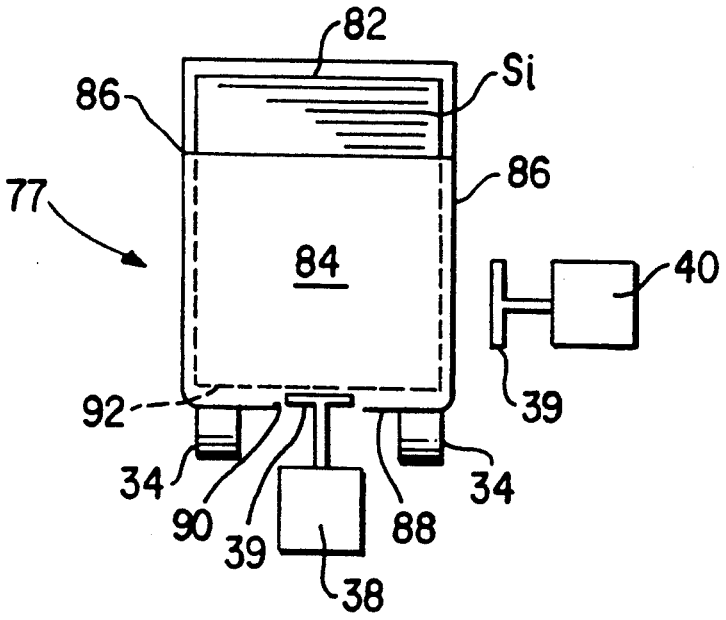
FIG. 6 is a front schematic elevation of the stack container shown in FIG. 5.

Referring to FIGS. 5 and 6, containers 77, which can comprise the copy input sheet container 42 and/or the copy output container 50, are illustrated. The container 77 includes a back wall 82, a front wall 84 and two opposed side walls 86 extending between the back wall 82 and the front wall 84. Preferably, the front wall 84 is of a lesser vertical height than the back wall 82 so that a portion of the stack $S_I$ is revealed for engagement by the feeder 36.

The containers 77 can be reusable or can comprise single use elements that provide for the handling of a predetermined number of sheets. If reusable, the containers 77 may be formed of plastic material and, if disposable, may be formed of cardboard.

Preferably, each container 77 includes a bottom plate 92 on which the stack of sheets is supported. The plate 42 is mounted for vertical movement within the container 77. Each container includes a bottom wall 88 having an opening 90 generally centrally located therein. The elevating means 38 with the drivable plate 39 is positioned for engaging the plate 92 through the opening 90, as the container 77 rests on the conveyor 34. In this manner, the stack of sheets can be fed upwardly as the feeder 36 feeds sheets from the stack. The moving member 40, as shown in FIG. 6, is positioned to drive plate 39 so that, when the stack $S_I$ is exhausted and the plate member 39 is withdrawn from the container, the empty container 77 can be moved transversely off the conveyor 34 and onto the unloading surface 28, as previously described. Although the foregoing description is in the context of supplying copy sheets to the sheet feeder 36, a similar arrangement can be employed for the output section 16. In this case, the plate 92 is initially positioned adjacent the top of the container 77 by suitable elevator structure and is withdrawn as the stacker 48 delivers sheets into the container 77.

A control arrangement (not shown) utilizing appropriate optical or contact sensors controls the operation of the container moving members 40, 52, 68, 70, 78 and 80. Suitable means for controlling of these elements are known and no further description is necessary.

In operation, in either the FIGS. 1, 2 or FIGS. 3, 4 arrangements, a plurality of input stacks $S_I$ are positioned on the conveyor 34 and a plurality of empty frames 50 are provided on the conveyor 46 prior to the start up of the printer. At start up, the feed and stacker arrangements commence operation and, as the frames 42, 50 are exhausted and/or filled, they are pushed to the exterior of the housing for attention by the machine attendant. In the FIGS. 1 and 2 embodiment, the containers 42 and 50 are manually removed from stations 27 and 31 and are manually positioned on conveyors 34 and 46. In the arrangements shown in FIGS. 3 and 4, a continuous supply of containers can be arranged at the input and output of the printer. A multiplicity of containers requiring input sheets or requiring unloading of output sheets can extend across the front face of the printer in the FIGS. 3 and 4 embodiment, thereby requiring less periodic visits by the operator. In addition, the empty and/or loaded trays comprise a visual signal to the operator that attention is necessary. The arrangement provides for continuous run or extended continuous run capabilities. Moreover, it is space efficient.

What is claimed is:

1. A sheet handling system for sheet printing apparatus comprising:

a housing;

a printing station within the housing;

at least three individual, separately movable sheet stack holding members;

first conveying means for sequentially conveying the at least three sheet stack holding members into the housing one after the other along an input path;

means in the housing for feeding sheets from one of the sheet stack holding members to the printing station; and means for separately moving each one of said sheet stack holding members out of the input path to a loading station outside the housing when the feeding means has finished feeding sheets from said one of the sheet holding members.

2. A sheet handling system as in claim 1, wherein the means for moving the sheet stacking members outside the housing moves the sheet holding members in a direction transverse to said input path.

3. A sheet handling system as in claim 1, further comprising:

second conveying means for conveying the sheet stack holding members from the loading station to the first conveying means.

4. A sheet handling system for sheet printing apparatus comprising:

a housing;

a printing station within the housing;

supply means for supplying sheets to the printing station;

at output member for receiving sheets from the printing station;

at least three individual, separately movable stack receiving members;

a first conveying means for sequentially conveying the at least three sheet receiving members into the housing along an input path, one after the other, and positioning one of the sheet receiving members at an output position for receiving sheets from the output member;

means for separately moving each one of the sheet receiving members out of the input path from the output position adjacent the output member to an unloading station outside the housing after a stack of sheets has been deposited in the sheet receiving member by the output member.

5. A sheet handling system as in claim 4, wherein the means for moving a sheet receiving member to the unloading station moves the sheet receiving members in a direction transverse to the input path.

6. A sheet handling system as in claim 4, further comprising:

a second conveying means for conveying sheet receiving members from the unloading station to the first conveying means.

7. A sheet handling system for a sheet printing apparatus comprising:

a housing;

a printing station within the housing;

at least three individual, separately movable sheet stack holding members;

a first conveying means for conveying the sheet stack holding members into the housing one after the other along an input path;

means for feeding sheets from a sheet stack holding member in the housing to the printing station;

means for separately moving one of said sheet stack holding members out of the input path to a loading station outside the housing when the feeding means has finished feeding sheets from said one of said at least three sheet stack holding members;

an output member for receiving sheets from the printing station;

at least three individual, separately movable sheet stack receiving members;

a seconding conveying means for conveying the sheet stack receiving members into the housing along a second input path and for positioning one of the sheet stack receiving members for receiving sheets from the output member; and means for separately moving one of said at least three sheet stack receiving members from a position adjacent the output member to an unloading station outside the housing after a stack of sheets has been deposited in said one sheet stack receiving member by the output member.

8. A sheet handling system as in claim 7, wherein the means for moving the sheet stack holding members outside the housing moves the sheet stacking members in a direction transverse to said first input path and the means for moving the sheet stack receiving members outside the housing moves the sheet stack receiving means in a direction transverse to said second input path.

9. A sheet handling system as in claim 7, and further comprising:

a third conveying means for conveying the sheet stack members from the loading station to the first conveying means; and a fourth conveying means for conveying the sheet stack receiving members from the unloading station to the second conveying means.

10. A sheet handling system as in claim 7, wherein the housing includes a first and a second opposed end walls and a front wall extending between the opposed end walls and wherein the first conveying means extends through the first end wall, the second conveying means extends through the second end wall and the loading station and the unloading station are located on the front wall.

11. A sheet handling apparatus as in claim 9, wherein the housing includes a first and a second opposed end walls and a front wall extending between the opposed end walls and wherein the first conveying means extends through the first end wall, the second positioning means extends through the second end wall and the loading station and the unloading station are located on the front wall.

12. A sheet handling apparatus as in claim 11, wherein the third conveying means comprises an L-shaped member.

13. A sheet handling apparatus as in claim 11, wherein the fourth conveying means comprises an L-shaped member.

14. A sheet handling apparatus as in claim 11, wherein the third and fourth conveying means comprise L-shaped members.

15. A sheet handling system for a sheet printing apparatus comprising:

a housing;

a printing station within the housing;

at least three sheet stack holding members;

a first conveying means for conveying the sheet stack holding members into the housing one after the other along an input path;

means for feeding sheets from a sheet stack holding member in the housing to the printing station;

means for moving one of said sheet stack holding members to a loading station outside the housing when the feeding means has finished feeding sheets from said one of said sheet stack holding members;

an output member for receiving sheets from the printing station;

at least three sheet stack receiving members;

a seconding conveying means for conveying the sheet stack receiving members into the housing along a second input path and for positioning one of the sheet stack receiving members for receiving sheets from the output member;

means for moving one of said sheet stack receiving members from a position adjacent the output member to an unloading station outside the housing after a stack of sheets has been deposited in said one sheet stack receiving member by the output member; and said housing including a first and a second opposed end walls and a front wall extending between the opposed end walls and wherein the first conveying means extends through the first end wall, the second conveying means extends through the second end wall and the loading station and the unloading station are located on the front wall.

16. A sheet handling system for a sheet printing apparatus comprising:

a housing;

a printing station within the housing;

at least three sheet stack holding members;

a first conveying means for conveying the sheet stack holding members into the housing one after the other along an input path;

means for feeding sheets from a sheet stack holding member in the housing to the printing station;

means for moving one of said sheet stack holding members to a loading station outside the housing when the feeding means has finished feeding sheets from said one of said sheet stack holding members;

an output member for receiving sheets from the printing station;

at least three sheet stack receiving members;

a seconding conveying means for conveying the sheet stack receiving members into the housing along a second input path and for positioning one of the sheet stack receiving members for receiving sheets from the output member;

means for moving one of said sheet stack receiving members from a position adjacent the output member to an unloading station outside the housing after a stack of sheets has been deposited in said one sheet stack receiving member by the output member;

a third conveying means for conveying the sheet stack holding members from the loading station to the first conveying means;

a fourth conveying means for conveying the sheet stack receiving members from the unloading station to the second conveying means; and wherein the housing includes a first and a second opposed end walls and a front wall extending between the opposed end walls and wherein the first conveying means extends through the first end wall, the second conveying means extends through the second end wall and the loading station and the unloading station are located on the front wall.

17. A sheet handling apparatus as in claim 16, wherein the third conveying means comprises an L-shaped member.

18. A sheet handling apparatus as in claim 16, wherein the fourth conveying means comprises an L-shaped member.

19. A sheet handling apparatus as in claim 16, wherein the third and fourth conveying means comprise L-shaped members.

* * * * *